US006397654B1

(12) United States Patent
Moeser

(10) Patent No.: US 6,397,654 B1
(45) Date of Patent: Jun. 4, 2002

(54) DEVICE FOR CARRYING OUT MECHANICAL TASKS ON COMPONENTS BY MEANS OF TOOL ELEMENTS ARRANGED ON A, PREFERABLY C-SHAPED, TOOL HOLDER

(75) Inventor: Joachim Moeser, Gruenberg (DE)

(73) Assignee: Emhart Inc., Newark, DE (US)

( * ) Notice: Subject to any disclaimer, the term of this patent is extended or adjusted under 35 U.S.C. 154(b) by 0 days.

(21) Appl. No.: 09/592,395

(22) Filed: Jun. 13, 2000

(30) Foreign Application Priority Data

Jun. 14, 1999 (DE) ..... 299 10 335 U

(51) Int. Cl.[7] ..... B21J 9/18
(52) U.S. Cl. ..... 72/447; 100/231
(58) Field of Search ..... 72/447; 100/231

(56) References Cited

U.S. PATENT DOCUMENTS 493,928 A * 3/1893 Heyde ..... 72/447
2,572,949 A * 10/1951 Reese ..... 100/231
2,573,574 A * 10/1951 Johansen ..... 100/231
2,837,992 A * 6/1958 Wissman ..... 100/231
4,007,679 A * 2/1977 Edwards ..... 100/231
5,425,262 A 6/1995 Dubugnon

* cited by examiner

*Primary Examiner*—David Jones
(74) *Attorney, Agent, or Firm*—Edward D. Murphy

(57) ABSTRACT

The present invention relates to a device for carrying out mechanical tasks, in particular pressing, riveting, folding and cutting, on components by means of tool elements (2, 3) arranged on a substantially one-piece, preferably C-shaped tool holder (1) defining an operating region (4). The tool holder (1) is held via a first rotational connection (5) as vertically pivotal in a mount (6). The operating region (4) has a large insertion depth for the components, which is achieved according to the invention in that the first rotational connection (5) is arranged in a position at a significant distance from the centre of gravity (7) of the tool holder (1). Owing to the fact that on vertical pivoting of the tool holder (1) a spring element (8), preferably a gas pressure spring (8), is tensioned in such a way and a pressure force is generated which is approximately equal to the force arising from the positioning of the first rotational connection (5) at a distance from the centre of gravity (7), it is ensured in an advantageous manner that the device remains upright in any chosen working position almost without force.

10 Claims, 4 Drawing Sheets

DEVICE FOR CARRYING OUT MECHANICAL TASKS ON COMPONENTS BY MEANS OF TOOL ELEMENTS ARRANGED ON A, PREFERABLY C-SHAPED, TOOL HOLDER

BACKGROUND OF THE INVENTION

The present invention relates to a device for carrying out mechanical tasks, in particular pressing, riveting, folding and cutting, on components by means of tool elements arranged on a substantially one-piece, approximately C-shaped tool holder defining an operating region in such a way that during operating between the tool elements the components can be positioned at least partially in the operating region. The tasks can be done hydraulically, pneumatically, electrically or in combination with one another.

A generic device, in this case for connecting in one working process two or more elements formed from metal sheets located on top of one another, is known, for example, from U.S. Pat. No. 5,425,262. At least one stroke or a movement along a pre-determined path is carried out by at least one active tool element towards a tool element cooperating with it. The tool elements are arranged respectively on a tool holder and form first and second tool holders with a defined operating region in between. During the working process, the elements to be connected to one another, formed from sheet metal, are positioned in the operating region, i.e. between the tool elements. The first and second tool holders can be moved towards one another in a rotational movement round a rotational connection in a first part of the stroke mentioned. Additionally the device has a locking mechanism which locks the rotational movement between the first and the second tool holders at the end of the first part of the stroke. The rotational connection is arranged in a position near the centre of gravity of one of the two tool holders between a line through the active and cooperating tool elements on the one hand and the locking mechanism on the other hand.

The arrangement of the rotational connection near the centre of gravity has the advantage that no otherwise arising moment forces have to be taken into consideration, in particular balanced. An arrangement of this kind has the disadvantage, though, that the operating region has to be kept relatively small with respect to its insertion depth for the components if one does not wish to create correspondingly voluminously dimensioned and thus relatively heavy devices which at the same time have to accommodate very high forces, for example during a connecting process.

SUMMARY OF THE PRESENT INVENTION

It is the object of the present invention to make available a relatively light, preferably hand-operated, compact device for carrying out mechanical tasks, in particular pressing, riveting, folding and cutting, on components, with an operating region which also allows tasks at a greater insertion depth on components. In particular it is to be ensured that the device remains upright in any chosen working position almost without force.

In the device according to the invention for carrying out tasks on components by means of tool elements arranged on a substantially one-piece, approximately C-shaped tool holder defining an operating region in such a way that during operating between the tool elements the components can be positioned at least partially in the operating region, the tool holder is held via a first rotational connection as vertically pivotal in a mount, and the first rotational connection is arranged in a position at a significant distance from the centre of gravity of the tool holder, wherein at least one holding element is provided for an approximate balance of moments arising as a result of the positioning of the first connection at a distance from the centre of gravity into different positions of the tool holder.

The significant distancing of the first rotational connection from the centre of gravity has in particular the advantage that an operating region can be formed with a large insertion depth for the components, so, in an advantageous manner, tasks can also be carried out at a correspondingly larger depth on components, which otherwise could not be carried out by means of a generic device.

Owing to the fact that a holding element is provided, by means of which the moments arising because of the positioning of the first rotational connection at a distance from the centre of gravity can be approximately balanced in different positions of the tool holder, very accurate positioning of the device is made possible. Furthermore, the holding element ensures that no, or only very slight, moments are passed into holding devices of the devices when the device is pivoted round the rotational connection. This is of particular advantage if the device is arranged on an arm of a robot or a robotal device. There is therefore no need for additional measures on the robot arm or the robotal device to compensate for the moments caused by pivoting of the device.

The device according to the invention is also suitable for hand-activated use. With a relatively small expenditure of force the operator of the device can pivot the tool holder into pre-determined positions.

It is preferred according to the invention that the distance between the first rotational connection and the centre of gravity is greater than 5 cm and, preferably, at least 15 cm.

According to an advantageous configuration of the device it is proposed that the holding element is formed by at least one spring element. This achieves a reliable and safe configuration of the holding element.

If the first rotational connection and the centre of gravity lie in a common vertical line the spring element is preferably biased.

The spring element is preferably biased at a maximum force. In a resting position the force vector of the spring element points at the rotational point, so the moment constituted by the spring element is almost zero. The moment necessary for the rotation of the tool holder rises sinusoidally and reaches a maximum when the tool holder is rotated round an angle of 90°. The lifting arm, by means of which the spring element generates a rotational moment, which can also be designated as a re-adjusting moment, becomes sinusoidally larger. The spring force of the spring element is reduced to about 80% of the maximum force during rotation round 90°. Because the lifting arm is getting larger during pivoting of the tool holder, the moment necessary for pivoting the tool holder is reduced.

If, however, the tool holder is vertically pivoted, for example by hand, the spring element tenses and generates a moment which is approximately equal to the moment arising because of the positioning of the first rotational connection at a distance from the centre of gravity as a result of gravitational force.

This ensures in an advantageous manner that the device remains upright in any chosen working position almost without force.

It has been found that a particularly good moment balance is produced if the spring element is arranged between mount and tool holder.

It is preferred according to the invention that the spring element is a gas pressure spring. Other suitable spring elements can also be used.

In order to achieve working positions beyond the vertical pivoting region too, it is proposed that the mount is held via a second rotational connection on a holding device and pivotally round an axis located in the horizontal line.

In order to be able to control working positions in a three-dimensional space it is proposed to hold the holding device pivotally round an axis located in the vertical line.

It is preferred according to the invention that the device is made in such a way that it can be operated by hand. For this purpose at least one handle region, preferably at least two handle regions, is formed on the tool holder.

The device according to the invention for carrying out tasks on components is characterised by its great ease of handling, which is additionally improved in that the device can, on the whole, be designed as very slim.

Further advantages and details of the invention are explained with reference to a preferred embodiment illustrated in the drawings, this being a device for connecting in one working process two or more elements formed from metal sheets located on top of one another by means of riveting, to which, however, the invention is not restricted.

BRIEF DESCRIPTION OF ACCOMPANYING DRAWINGS

DETAILED DESCRIPTION OF THE PREFERRED EMBODIMENT

Figure 1:
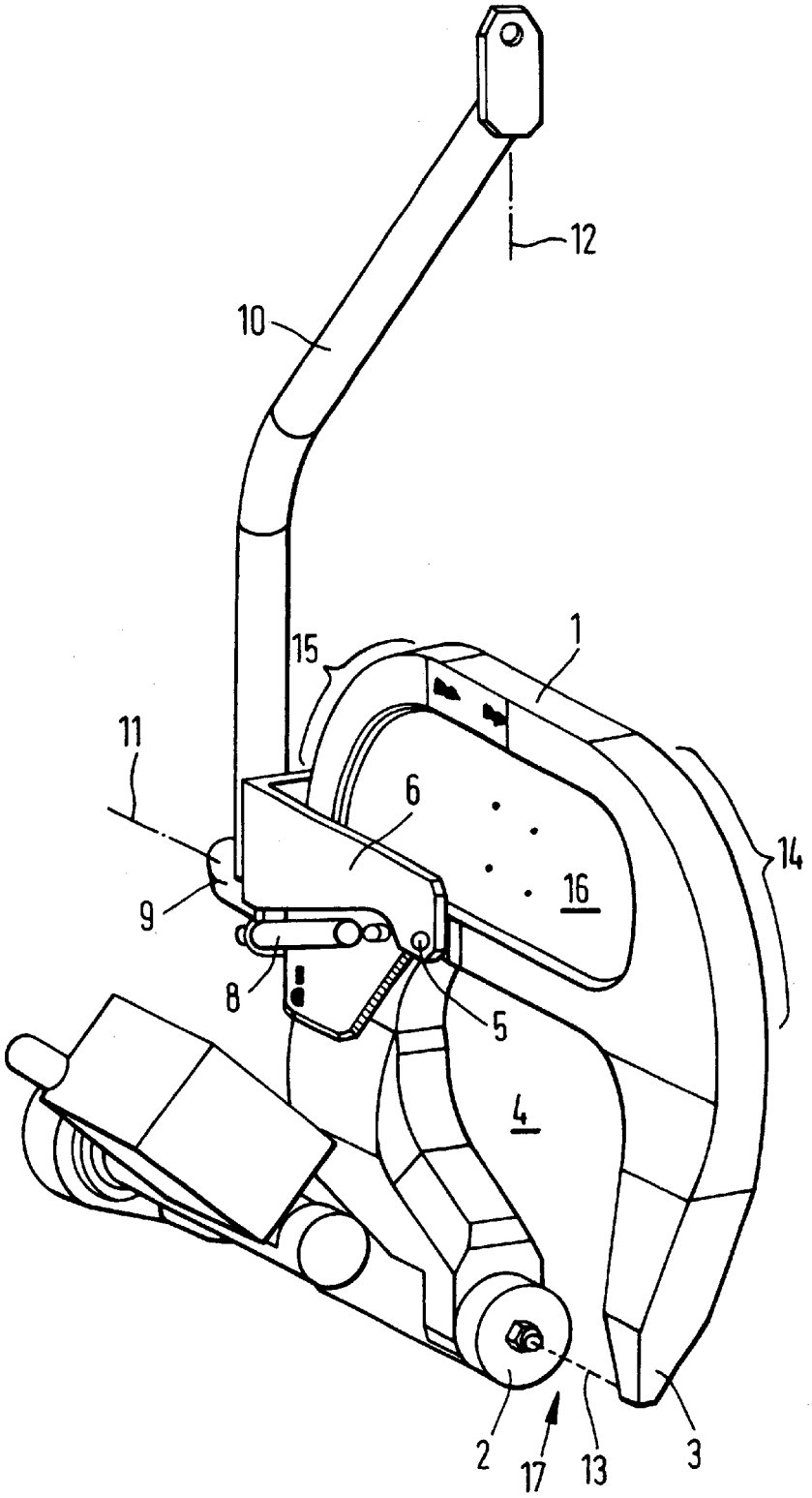
FIG. 1 shows a device according to the invention in a first working position in perspective view.
Figure 2:
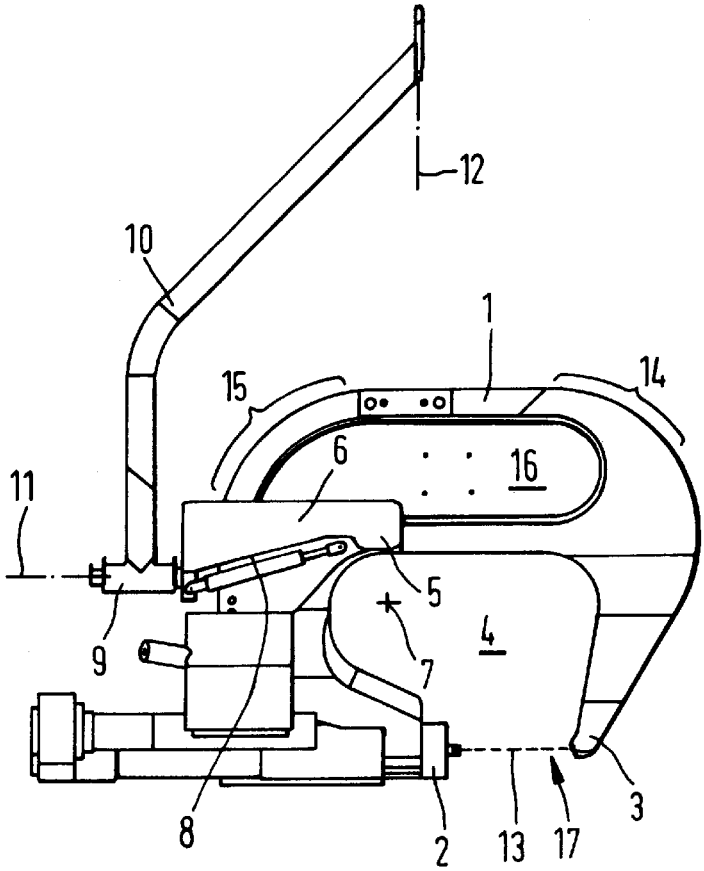
FIGS. 2 to 4 show the device according to FIG. 1 in a front view, a side view and a horizontal projection.
Figure 3:
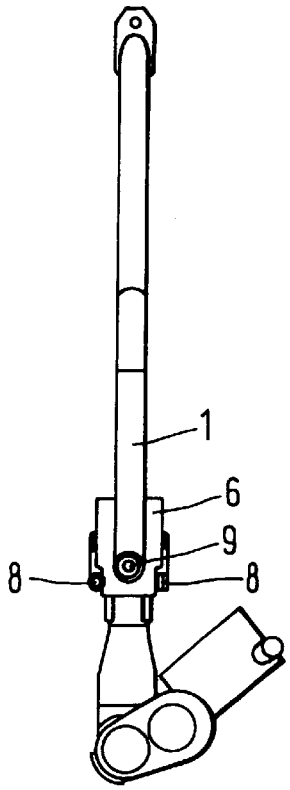

FIGS. 1 to 4 show a preferred embodiment according to the invention of a device for connecting in one working process two or more elements formed of metal sheets (not illustrated) located on top of one another by means of riveting in a first (horizontal) working position. Herein at least one stroke or one movement along a pre-determined path 13 is carried out by at least one active tool element 2, e.g., designed as a die, towards a tool element 3, e.g. designed as a die-plate, cooperating therewith. The die designed as an active tool element 2 is equipped with an activating system, so during operation of the tool, a relative movement can be generated between die 2 and die-plate 3. A system of this kind comprises, for example, a hydraulic or pneumatic cylinder-piston module or an E-motor. Both tool elements can also be designed in such a way that they respectively cover a partial stroke. Die 2 and die-plate 3 are arranged on a substantially one-piece, preferably approximately C-hoop-shaped, tool holder 1, which defines an operating region 4, in such a way that during the working process between the tool elements 2, 3 the elements formed of sheet metal to be connected to one another can be positioned at least partially in the operating region 4 through an orifice 17. The fact that the tool holder 1 is made in one piece has the advantage that expensive locking mechanisms, as known from the state of the art, are not necessary.

To reduce the mass of the tool holder 1 it has a region of reduced material thickness 16 in its hoop region. The tool holder 1 is held via at least one first rotational connection 5, here illustrated as a simple peg, as vertically pivotal in a mount 6, wherein the first rotational connection 5 is arranged in a position at a significant distance from the centre of gravity 7 of the tool holder 1. This creates in an advantageous manner an operating region 4 with an enlarged insertion depth for the components, which also allows connections further inside the components and not only substantially on their edge. The orifice 17 between the tool elements 2, 3, i.e. the die 2 and the die-plate 3, is at its maximum width in the position shown in the figures, so components with varying geometry and large dimensions can be inserted through the orifice 17 into the operating region 4 comprising a large insertion depth. The orifice 17 is preferably dimensioned in such a way that, for example, rivet connections can be carried out on shafts of motor vehicles.

Figure 4:
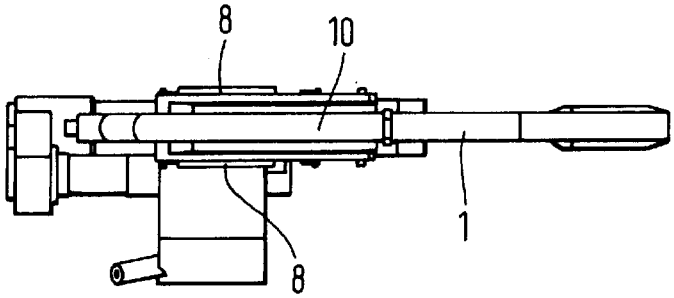
Figure 5:
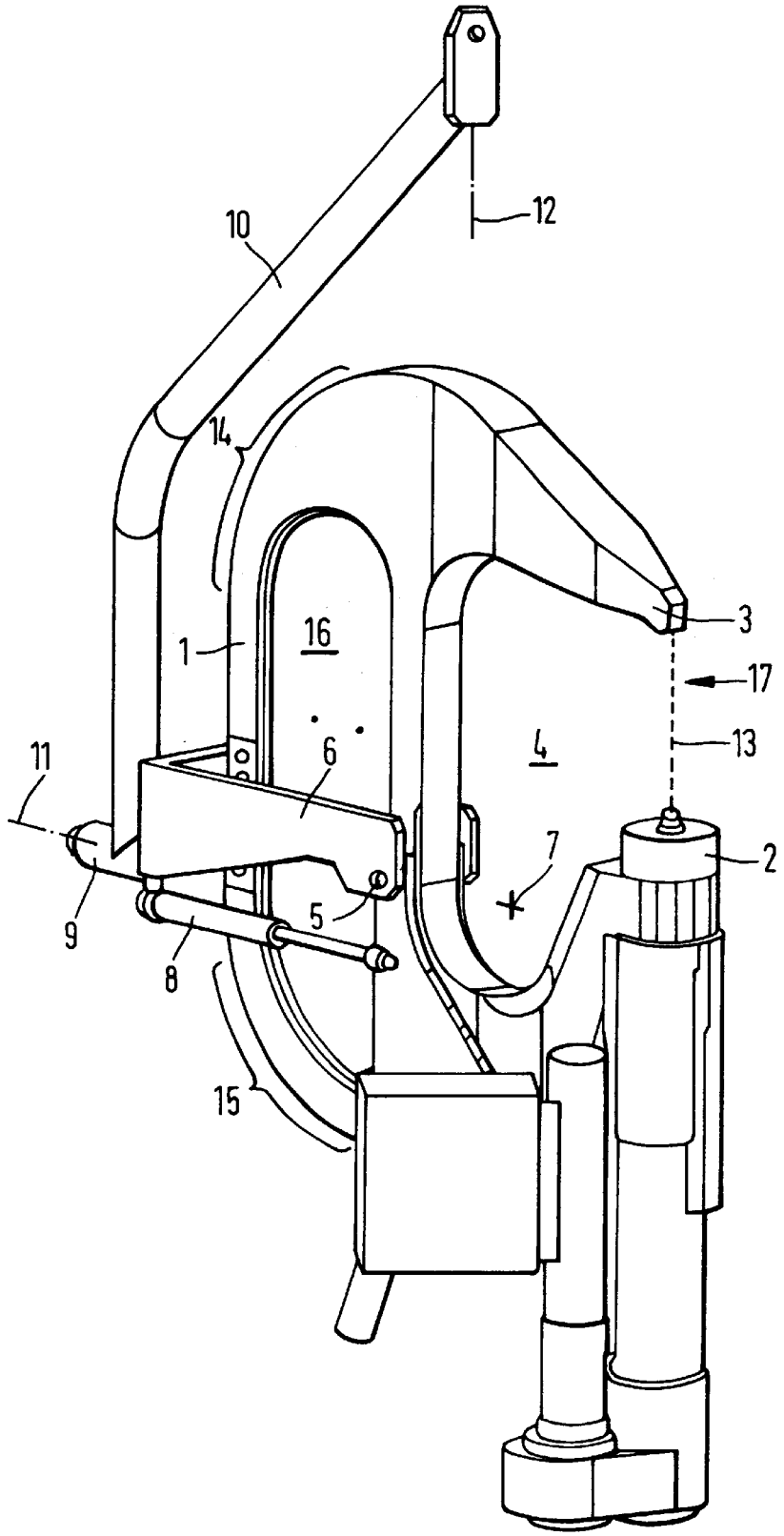
FIG. 5 shows the device according to the invention in a second working position, offset by 90° compared with FIG. 1, in perspective view.
Figure 6:
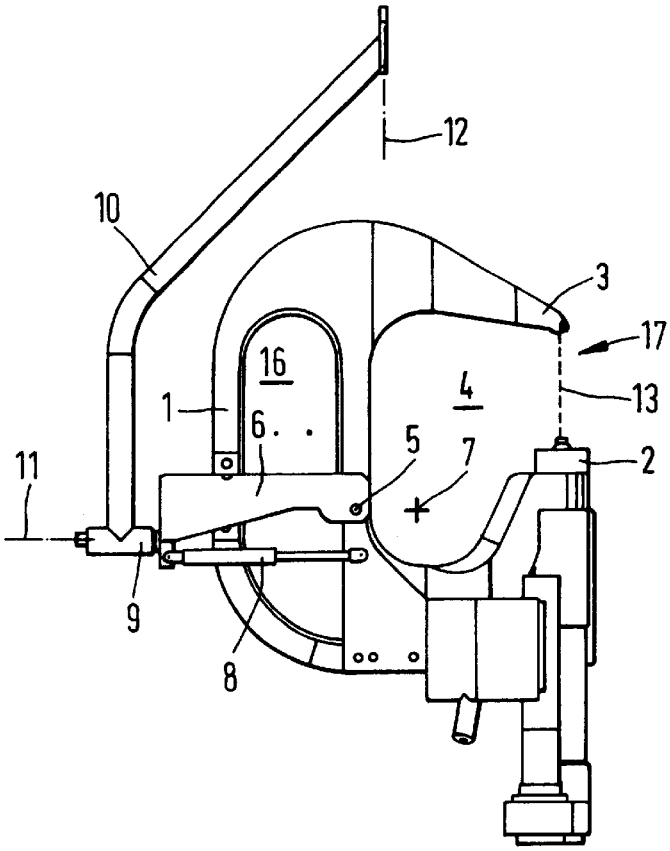
FIGS. 6 to 8 show the device according to FIG. 5 in a front view, a side view and a horizontal projecion.
Figure 7:
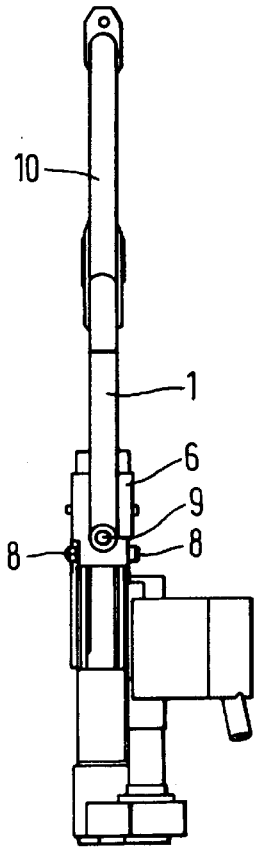
Figure 8:
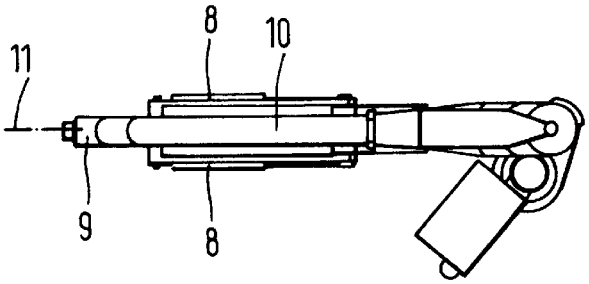

The distance between the first rotational connection 5 and the centre of gravity 7 of the tool holder 1 is preferably about 15 cm. For an approximate balance of the moments resulting from the positioning of the first rotational connection 5 at a distance from the centre of gravity 7 during vertical pivoting of the tool holder 1, at least one spring element 8 is provided. In the embodiment two gas pressure springs 8 are used as spring elements and are arranged respectively laterally to the device between mount 6 and tool holder 1, as shown in FIG. 4.

As already mentioned, FIGS. 1 to 4 show the device according to the invention for connecting elements in a first working position. In this position the first rotational connection 5 and the centre of gravity 7 of the tool holder 1 are located in a common vertical line, so the gas pressure springs 8 are approximately free of tension.

FIGS. 5 to 8 show the device according to the invention in a second working position, pivoted round 90° compared with FIGS. 1 to 4. The centre of gravity 7 and the first rotational connection 5 are now located at a significant distance in a common horizontal line. The gas pressure springs 8 are tensioned in such a way and generate a moment of a kind which corresponds to the moment arising from the positioning of the first rotational connection 5 at a distance from the centre of gravity 7 owing to the force of gravity. The tool holder 1 therefore remains upright in an advantageous manner within the vertical pivoting region in any chosen working position approximately free of moments.

To achieve any chosen working position in a defined three-dimensional space the mount 6 is held via a second rotational connection 9 on a holding device 10 pivotally round an axis 11 located in the horizontal line and the holding device 10 is held pivotally round an axis 12 held in the vertical line.

If the moment generated by the gas pressure springs 8 is of a similar size to the moment resulting from the positioning of the first rotational connection 5 at a distance from the centre of gravity (7), the device according to the invention is, in particular, also light and easily operated by hand. The substantially C-shaped tool holder 1 therefore has two handle regions 14, 15, which are preferably formed in the region of reduced material thickness 16 of the tool holder 1. It is a good idea to provide main tripping devices for a source of current and a control system for the tool elements 2, 3 in the handle regions 14, 15.

The device according to the invention for carrying out tasks on components is characterised by its ease of handling, which is additionally improved in that the device can on the whole be designed as very slim, as can also be seen from the figures. It can therefore be used in working regions with difficult access, in particular for rivet connections on shafts of motor vehicles.

What is claimed is:

1. A device for carrying out tasks on components, which comprises:

a one-piece tool holder (1) formed with region-defining structure, and having a center of gravity at a first prescribed location;

an operating region (4) defined by the region-defining structure of the one-piece tool holder (1) for receipt of at least portions of the components;

the one-piece tool holder (1) formed with structure for supporting spaced tool elements (2,3) which carry out the tasks on the components while the at least portions of the components are locatable in the operating region (4);

a mount (6) supported in a fixed position;

a rotational connection (5) attached fixedly to the mount (6) at a second prescribed location spaced above the center of gravity (7) and coupled to the one-piece tool holder (1) to facilitate movement of the one-piece tool holder (1) in a rotational direction relative to the mount (6) thereby to locate the one-piece tool holder (1) in any of a plurality of positions relative to the mount (6); and at least one holding element (8) is located to provide generally for a balance of moments resulting from the positioning of the rotational connection (5) at a prescribed distance from the center of gravity (7) in the plurality of positions of the one-piece tool holder (1).

2. The device according to claim 1, which further comprises:

the distance between the rotational connection (5) and the center of gravity (7) is at least 5 cm.

3. The device according to claim 2 or 1, which further comprises:

the holding element (8) is formed by at least one spring element (8).

4. The device according to claim 3, which further comprises:

the mount (6) extending from a first end to a second end thereof in a prescribed direction; and the spring element (8) is generally free of tension when the rotational connection (5) and the center of gravity (7) are located in a common line perpendicular to the prescribed direction of the mount (6).

5. The device according to claim 3, which further comprises:

the spring element (8) generates a moment around the rotational connection (5) which is approximately equal to and opposed to the moment resulting from the positioning of the rotational connection (5) at a distance from the center of gravity (7) due to the force of gravity.

6. The device according to claim 3, which further comprises:

the spring element (8) is arranged between the mount (6) and the tool holder (1).

7. The device according to claim 3, which further comprises:

the spring element (8) is a gas pressure spring (8).

8. The device according to claim 3, wherein the rotational connection (5) is a first rotational connection, which further comprises:

a holding device (10);

a second rotational connection (9);

the mount (6) extending from and between a first end to a second end thereof in a prescribed direction; and the mount (6) being held on the holding device (10) through the second rotational connection (9) pivotally around an axis (11) which is in the prescribed direction of the mount (6).

9. The device according to claim 8, which further comprises:

the holding device (10) is held pivotally around an axis (12) which is perpendicular to the prescribed direction of the mount (6).

10. The device according to claim 9, which further comprises:

at least one handle region (14) is formed on the tool holder (1).

* * * * *